US010012131B2

(12) United States Patent
Selinger et al.

(10) Patent No.: US 10,012,131 B2
(45) Date of Patent: Jul. 3, 2018

(54) CONTROLLING A COOLANT PUMP AND/OR CONTROL VALVE OF A COOLING SYSTEM FOR AN INTERNAL COMBUSTION ENGINE OF A MOTOR VEHICLE

(71) Applicant: GM GLOBAL TECHNOLOGY OPERATIONS LLC, Detroit, MI (US)

(72) Inventors: Michael Selinger, Mainz (DE); Mario Reichenbach, Wiesbaden (DE); Torsten Mueller, Rüsselsheim (DE); Michael Brinker, Ginsheim-Gustavsburg (DE)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 218 days.

(21) Appl. No.: 14/920,405

(22) Filed: Oct. 22, 2015

(65) Prior Publication Data

US 2016/0115858 A1 Apr. 28, 2016

(30) Foreign Application Priority Data

Oct. 22, 2014 (DE) ..... 10 2014 015 638

(51) Int. Cl.

| | |
|---|---|
| ***F01P 7/16*** | (2006.01) |
| *F01P 7/14* | (2006.01) |
| *F01P 7/00* | (2006.01) |

(52) U.S. Cl.

CPC ..... *F01P 7/164* (2013.01); *F01P 7/165* (2013.01); *F01P 7/00* (2013.01); *F01P 7/14* (2013.01); *F01P 7/16* (2013.01); *F01P 2007/146* (2013.01); *F01P 2025/32* (2013.01); *F01P 2025/34* (2013.01); *F01P 2025/36* (2013.01);

(Continued)

(58) Field of Classification Search

CPC ..... F01P 2007/146; F01P 7/161; F01P 7/162; F01P 7/164; F01P 7/167; F01P 2025/30; F01P 2025/34; F01P 2025/50; F01P 2025/52; F01P 2025/62

USPC ..... 123/198 C

See application file for complete search history.

(56) References Cited

U.S. PATENT DOCUMENTS

| | | | |
|---|---|---|---|
| 6,390,031 | B1 | 5/2002 | Kazutaka et al. |
| 6,520,125 | B2 | 2/2003 | Kazutaka et al. |
| 6,772,716 | B2 | 8/2004 | Chekaiban et al. |

(Continued)

FOREIGN PATENT DOCUMENTS

| | | | |
|---|---|---|---|
| DE | 19933794 | A1 | 2/2000 |
| DE | 102004040327 | A1 | 3/2006 |

(Continued)

OTHER PUBLICATIONS

German Patent Office, German Search Report for German Application No. 102014015638.9, dated Jun. 30, 2015.

*Primary Examiner* — Sizo Vilakazi
*Assistant Examiner* — Kevin R Steckbauer
(74) *Attorney, Agent, or Firm* — Lorenz & Kopf LLP

(57) ABSTRACT

The present disclosure relates to a method for determining an actuating value for a coolant pump or a control valve of a cooling system for an infernal combustion engine of a motor vehicle. In particular, a pre-control value for ascertaining the actuating value is determined in a first determination mode based on a prescribed first allocation as a function of an output variable of the infernal combustion engine and a temperature difference of a heat exchanger of the cooling system.

12 Claims, 1 Drawing Sheet

(52) U.S. Cl.
CPC .... *F01P 2025/60* (2013.01); *F02D 2200/021* (2013.01); *F02D 2200/1002* (2013.01)

(56) References Cited

U.S. PATENT DOCUMENTS

| | | | | |
|---|---|---|---|---|
| 6,904,875 | B2 * | 6/2005 | Kilger | F01P 7/164 123/41.1 |
| 7,128,026 | B2 | 10/2006 | Braun et al. | |
| 9,599,010 | B2 * | 3/2017 | Ichihara | F01P 7/16 |
| 9,611,781 | B2 * | 4/2017 | Moscherosch | F01P 7/162 |
| 2004/0065275 | A1 | 4/2004 | Hayami et al. | |
| 2004/0144340 | A1 * | 7/2004 | Kilger | F01P 7/164 123/41.1 |
| 2011/0265742 | A1 | 11/2011 | Choi et al. | |
| 2014/0303838 | A1 | 10/2014 | Nam et al. | |
| 2016/0160739 | A1 * | 6/2016 | Ichihara | F01P 7/16 123/41.09 |
| 2017/0122182 | A1 * | 5/2017 | Gonze | F01P 3/18 |

FOREIGN PATENT DOCUMENTS

| | | | | |
|---|---|---|---|---|
| DE | 102008049803 | A1 | 4/2010 | |
| GB | 2501699 | A * | 11/2013 | F01P 7/167 |
| WO | 03056153 | A1 | 7/2003 | |

* cited by examiner

CONTROLLING A COOLANT PUMP AND/OR CONTROL VALVE OF A COOLING SYSTEM FOR AN INTERNAL COMBUSTION ENGINE OF A MOTOR VEHICLE

CROSS-REFERENCE TO RELATED APPLICATION

This application claims priority to German Patent Application No. 102014015638.9, filed Oct. 22, 2014, which is incorporated herein by reference in its entirety.

TECHNICAL FIELD

The present disclosure pertains to a method for determining an actuating value for a coolant pump or a control valve of a cooling system for an internal combustion engine of a motor vehicle, a method for controlling the coolant pump and/or the control valve thereof based on this actuating value, and a motor vehicle with a controller set up to implement the method, as well as a corresponding computer program and computer program product.

BACKGROUND

WO 03/056153 A1 discloses a method for actuating a cooler mixing valve and an electrically activatable coolant pump of a cooling system for an internal combustion engine of a motor vehicle, in which a respective pre-control value is linked in an additive or proportional manner with a prioritized controller value of a PI controller for both components.

SUMMARY

The present disclosure provides for improved operation of a cooling system for an internal combustion system of a motor vehicle. In one aspect of the present disclosure, a motor vehicle, in particular a passenger car includes an internal combustion engine and a cooling system for cooling this internal combustion engine, with a coolant circuit that includes a heat exchanger and a bypass, which fluidically bridges the heat exchanger, in particular being fluidically arranged serially with the latter.

In an embodiment, the cooling system includes an electrically activatable coolant pump for variably conveying a coolant in the coolant circuit based on a pump actuating value. In a further development, a delivery volume or pumping rate and/or a speed of the coolant pump is or can be determined based on the pump actuating value, in particular proportionally to the pump actuating value.

In an embodiment, the cooling system includes an electrically activatable control valve for variably dividing a coolant flow between the heat exchanger and bypass based on a valve actuating value. In a further development, a valve position that controls the passage of coolant through the heat exchanger and/or bypass is or can be determined based on the valve actuating value, in particular proportionally to the valve actuating value.

In an aspect of the present disclosure, a simplifying assumption is made that heat introduced from the internal combustion engine into the coolant circuit is to be dissipated into the environment at thermodynamic equilibrium via the heat exchanger. The introduced heat depends on an output variable of the internal combustion engine and the dissipated heat depends on a temperature difference of the heat exchanger. Thus, it is advantageously possible to determine a pre-control value for ascertaining the pump actuating value and/or a pre-control value for ascertaining the valve actuating value.

Correspondingly, another aspect of the present disclosure involves determining a pre-control value for ascertaining the pump actuating value or an actuating value for a coolant pump of a cooling system for an internal combustion engine of a motor vehicle in a first determination mode based on a prescribed first allocation as a function of an output variable of the internal combustion engine and a temperature difference of a heat exchanger of the cooling system. Additionally or alternatively, a pre-control value for ascertaining the valve actuating value or an actuating value for a control valve of a cooling system for an internal combustion engine of a motor vehicle is determined in a first determination mode based on a prescribed first allocation as a function of an output variable of the internal combustion engine and a temperature difference of a heat exchanger of the cooling system.

In an embodiment, the output variable is determined based on a torque variable, which in a further development is proportional to an output torque of the internal combustion engine, and a speed variable of the internal combustion engine. In a further development the output variable is proportional to an output speed of the internal combustion engine. In a further development, the output variable is proportional to the torque and speed variable. In like manner, the output variable can also be determined based on a fuel supply, a driving resistance or the like, for example. In an embodiment, the pre-control value for ascertaining the pump actuating value and/or the pre-control value for ascertaining the valve actuating value is proportional to the output variable.

In an embodiment, the temperature difference of the heat exchanger is a temperature difference between the coolant inlet and coolant outlet of the heat exchanger or a difference in temperatures of the coolant before and after the heat exchanger, in particular at the coolant inlet and outlet. In like manner, the temperature difference of the heat exchanger can also be a temperature difference inside the heat exchanger if the latter can be used to estimate a heat emission of the heat exchanger, in particular a difference in temperatures of the coolant at different locations inside the heat exchanger. In an embodiment, the temperature difference is determined based on measured values from at least two temperature sensors, which are arranged spaced apart from each other in the flowing direction of the coolant before or after or even in the heat exchanger, in particular at the coolant inlet and outlet. In an embodiment, the pre-control value for ascertaining the pump actuating value and/or pre-control value for ascertaining the valve actuating value is inversely proportional to the temperature difference, or is proportional to the reciprocal value of the temperature difference.

Assuming for purposes of simplification that a heat introduced by the internal combustion engine into the coolant circuit ($dQ_e/dt$) depends, in particular proportionally, on the output variable, in particular the product of the torque T and speed n (T·n), of the internal combustion engine, and that the heat dissipated into the environment via the heat exchanger ($dQ_a/dt$) depends, in particular proportionally, on a temperature difference ($\Delta\vartheta$) of the heat exchanger, yields a simplified:

$$dV/dt = \propto \cdot (T \cdot n)/\Delta\vartheta$$

for the volume flow of coolant through the heat exchanger (dV/dt), with the factor, which particular can depend on the temperature of the coolant (α). Since the pumping rate of the coolant pump and the position of the control valve together influence this volume flow of the coolant through the heat exchanger, actuating values for the coolant pump and control valve can thus advantageously be ascertained as a function of an output variable of the internal combustion engine and a temperature difference of a heat exchanger of the cooling system.

In an aspect of the present disclosure, it will be recognized that the pre-control value described above is only conditionally suitable in certain situations. For example, a very small temperature difference of the heat exchanger can result in an inordinately large coolant flow being directed through the heat exchanger, so that the temperature difference of the heat exchanger decreases further, or at least does not increase rapidly, in particular in a self-facilitating manner.

In an embodiment, this is why the pump actuating value and/or valve actuating value is generally ascertained or determined in the first determination mode based on the pre-control value if a state variable of the cooling system satisfies a prescribed condition, and ascertained or determined in a second determination mode different from the above if the state variable does not satisfy the condition. In an embodiment, the state variable encompasses the temperature difference of the heat exchanger. In an embodiment, the pre-control value for ascertaining the pump actuating value and/or the pre-control value for ascertaining the valve actuating value is determined in the first determination mode in particular if the temperature difference of the heat exchanger exceeds a prescribed limit, and the pump and/or valve actuating value is ascertained in the second determination mode if the temperature difference does not exceed the limit. Additionally or alternatively, the state variable can include even more variables, for example a length of time for which the control valve was in a prescribed area.

In an embodiment, the pump actuating value and/or the valve actuating value is ascertained in the second determination mode based on a prescribed second allocation differing from the first allocation as a function of the output variable of the internal combustion engine and the temperature difference of the heat exchanger of the cooling system, in particular based on a pre-control value in the same way as described with reference to the first determination mode.

In particular, an allocation can include, especially be, a prescribed characteristic diagram, a prescribed characteristic line or the like. In an embodiment, a first allocation for determining the pre-control value to ascertain the pump actuating value encompasses a characteristic line that maps different values for the output variable of the internal combustion engine and the temperature difference of the heat exchanger or a variable depending on the latter onto different pre-control values for the coolant pump, a second allocation for determining the pre-control value to ascertain the pump actuating value encompasses a characteristic line that maps different values for the output variable of the internal combustion engine and the temperature difference of the heat exchanger or a variable depending on the latter onto other different pre-control values for the coolant pump, a first allocation for determining the pre-control value to ascertain the valve adjusting value of a characteristic line that maps different values for the output variable of the internal combustion engine and the temperature difference of the heat exchanger or a variable depending on the latter onto different pre-control values for the control valve, and/or a second allocation for determining the pre-control value to ascertain the valve actuating value encompasses a characteristic line that maps different values for the output variable of the internal combustion engine and the temperature difference of the heat exchanger or a variable depending on the latter onto other different pre-control values for the control valve.

In like manner, the pump actuating value and/or valve actuating value can in particular be a respective pre-determined value or ascertained or determined in some other way in the second determination mode.

In an aspect of the present disclosure, it was recognized that the coolant pump and control valve together influence the coolant flow through the heat exchanger, so that various combinations of actuating values are possible for the coolant pump and control valve for realizing a desired heat emission via the heat exchanger. It was here further recognized that different combinations are particularly favorable in various operating situations. In an embodiment, for example, a lower pumping rate for the coolant pump can reduce its energy demand, wherein the control valve then guides a larger volume flow percentage into the heat exchanger. By contrast, in another embodiment, in particular at high loads on the internal combustion engine, a higher pumping rate of the coolant pump may be beneficial to advantageously dissipate heat from the internal combustion engine.

In an embodiment, the pre-control value for ascertaining the pump actuating value and/or the pre-control value for ascertaining the valve actuating value is for this reason generally determined in a first determination mode based on a prescribed first allocation as a function of the output variable of the internal combustion engine and the temperature difference of the heat exchanger if a load variable of the internal combustion engine satisfies a prescribed condition, and in a second determination mode differing from the latter based on a prescribed second allocation differing from the first allocation as a function of the output variable of the internal combustion engine and the temperature difference of the heat exchanger if the load variable does not satisfy the condition. As already explained above with reference to the first and second allocation, in an embodiment, a first allocation for determining the pre-control value to ascertain the pump actuating value encompasses a characteristic line that maps different values for the output variable of the internal combustion engine and the temperature difference of the heat exchanger or a variable depending on the latter onto different pre-control values for the coolant pump, a second allocation for determining the pre-control value to ascertain the pump actuating value encompasses a characteristic line that maps different values for the output variable of the internal combustion engine and the temperature difference of the heat exchanger or a variable depending on the latter onto other different pre-control values for the coolant pump, a first allocation for determining the pre-control value to ascertain the valve actuating value encompasses a characteristic line that maps different values for the output variable of the internal combustion engine and the temperature difference of the heat exchanger or a variable depending on the latter onto different pre-control values for the control valve, and/or a second allocation for determining the pre-control value to ascertain the valve actuating value encompasses a characteristic line that maps different values for the output variable of the internal combustion engine and the temperature difference of the heat exchanger or a variable depending on the latter onto other different pre-control values for the control valve.

In an embodiment, the load variable encompasses a torque variable for the internal combustion engine. In particular, the pre-control value can be determined in the first determination mode, when the load, in particular torque, variable exceeds a prescribed limit, and can be determined in the second determination mode if the load, in particular torque, variable does not exceed the prescribed limit. In a further development, the first allocation can here prescribe larger pumping rates of the coolant pump and/or smaller volume flow percentages through the heat exchanger determined by the control valve or larger volume flow percentages through the bypass determined by the control valve than the second allocation.

In an embodiment, the coolant pump, in particular in the first determination mode, is controlled based on a control deviation between a desired and actual temperature variable and/or a differential variable thereof, wherein the term "control" can more generally also be understood as "regulate." Additionally or alternatively, in an embodiment, the control valve, in particular in the first determination mode is controlled based on a control deviation between a desired and actual temperature variable and/or a differential variable thereof. In this regard, reference is again made to the WO 03/056 153 A1 mentioned at the outset, so that related differences discussed below will be appreciated.

In an embodiment of the present disclosure, the coolant ump is thus controlled independently of a control deviation between a desired and actual temperature variable, in particular solely based on the pre-control value, and the control valve is also controlled based on a control deviation between a desired and actual temperature variable, especially of the coolant. In other words, the coolant pump is feed forward-controlled, and the control valve is feedback-controlled or regulated. This makes it possible to advantageously reduce interactions between the coolant pump and control valve. In one embodiment in particular, the pump actuating value can be the pre-control value for determining the pump actuating value, or be proportional thereto.

In an aspect of the present disclosure, it will be recognized that a proportional, differential and/or integral regulator (PID) known in the art responds suitably to abrupt changes in the operating situation only to a limited extent.

In an embodiment, this is why a control value is determined based on a control deviation between a desired and actual temperature variable, and/or based on a differential variable thereof, wherein, in a first control mode, the actuating value, in particular the valve actuating value, is determined based on this control value and the pre-control value, in particular the pre-control value for ascertaining the valve actuating value, if a prescribed criterion has been satisfied, and, in a second control mode different from the above, the actuating value is determined based on the control value and an integral variable of the control deviation if the criterion has not been satisfied. In an embodiment, this makes it possible to advantageously respond to abrupt changes in an operating situation, for example a rapid increase in the torque of the internal combustion engine. In an embodiment, an integral percentage can again be used in place of the pre-control value for control or regulation purposes if the change has concluded. In an embodiment, the actuating value, in particular the valve actuating value, consists of the control value added to the pre-control value for determining the valve actuating value or integral variable, or is proportional to this sum.

In particular, a change to which a regulator responds only to a limited extent can be recognized from a corresponding change in the pre-control values. This is why the criterion encompasses a change rate of a pre-control value in one embodiment. In particular, in an embodiment, the actuating value in the first control mode is determined based on the control value and pre-control value if the change rate of a pre-control value exceeds a prescribed limit, and the actuating value in the second control mode is determined based on the control value and integral variable if the change rate of the pre-control value does not exceed the limit.

In an aspect of the present disclosure, the coolant pump is controlled based on the pump actuating value, in particular proportionally thereto, which is determined in a manner described herein, for example via a corresponding energization. Additionally or alternatively, in an aspect of the present disclosure, the control valve or its position or opening is controlled based on the valve actuating value, in particular proportionally thereto, which is determined in a manner described herein, for example by correspondingly turning a rotary control valve or opening or closing a check valve. Accordingly, in an aspect of the present disclosure, the motor vehicle includes a controller for controlling the coolant pump and control valve, which are provided or set up, in particular from a programming standpoint, to implement a method in a manner described herein. In a further development, the controller controls the coolant pump based on the pump actuating value, in particular proportionally thereto, and the control valve based on the valve actuating value, in particular proportional thereto.

In an aspect of the present disclosure, a computer program includes a sequence of commands provided or designed to implement a method described herein when executed on a computer, in particular a controller of a motor vehicle. In a further aspect of the present disclosure, a computer program product includes a program code stored on a computer-readable medium, in particular a data carrier, for implementing a method according to one of the preceding claims.

Further proposed is a device for determining an actuating value for a coolant pump or a control valve of a cooling system for an internal combustion engine of a motor vehicle. The device includes a processor or controller configured to determine a pre-control value to ascertain the actuating value in a first determination mod based on a prescribed first allocation as a function of an output variable of the internal combustion engine and a temperature difference for a heat exchanger of the cooling system. In an embodiment, the processor controller is configured to determine the output variable based on a torque and speed variable of the internal combustion engine. In an embodiment, the processor or controller is further configured to determine the actuating value in a first determination mode if a state variable of the cooling system satisfies a prescribed condition, and to determine the actuating value in a second determination mode different from the latter if the state variable does not satisfy the condition.

In a further development, the device includes a processor or controller configured to determine the actuating value in the second determination mode based on a prescribed second allocation different from the first allocation as a function of the output variable of the internal combustion engine and the temperature difference of the heat exchanger of the cooling system or to determine a pre-determined actuating value in the second determination mode. In an embodiment, the device includes a processor or controller configured to determine the pre-control value in a first determination mode based on a prescribed first allocation as a function of the output variable of the internal combustion engine and the temperature difference of the heat exchanger if a load variable of the internal combustion engine satisfies a prescribed condition, and to determine the pre-control value in a second determination mode differing from the latter based on a prescribed second allocation differing from the first allocation as a function of the output variable of the internal combustion engine and the temperature difference of the heat exchanger if the load variable does not satisfy the condition.

In an embodiment, the device includes a processor or controller configured to determine a control value based on a control deviation between a desired and actual temperature variable and/or a differential variable thereof, to determine the actuating value in a first control mode based on the control value and pre-control value if a prescribed criterion has been satisfied, and to determine the actuating value in a second control mode differing from the latter based on the control value and an integral variable of the control deviation if the criterion has not been satisfied.

Further proposed is a device for controlling a coolant pump and/or a control valve of a cooling system for an internal combustion engine of a motor vehicle based on an actuating value. The device includes a controller configured to control the coolant pump based on a pump actuating value, and/or control the control valve based on a valve actuating value. The actuating value(s) can be determined by means of the processor or controller described herein configured to determine the pre-control value to ascertain the actuating value in a first determination mode based on a prescribed first allocation as a function of an output variable of the internal combustion engine and a temperature difference of a heat exchanger of the cooling system. Alternately, the controller may be configured to control the coolant pump and/or control valve or set up to control the coolant pump or control valve based on the actuating value determined by the device for determining an actuating value.

In an embodiment, the controller is configured to control the coolant pump independently of a control deviation between a desired and actual temperature variable, in particular of the coolant, based on the pre-control value, and to control the control valve based on a control deviation between a desired and actual temperature variable, in particular of the coolant.

Within the meaning of the present disclosure, a processor and/or controller can be designed as hardware and/or software, in particular include an in particular digital processor, in particular microprocessor unit (CPU), preferably connected in terms of data or signals with a storage and/or bus system, and/or one or more programs or program modules. The CPU can be designed to process commands implemented as a program filed in a storage system, acquire input signals from a data bus and/or relay output signals to a data bus. A storage system can include a non-transitory computer readable medium such as optical, magnetic, solid state and/or other nonvolatile media. The program can be constituted in such a way as to embody the method described herein or be capable of implementing it, so that the CPU can execute the steps in such a method, and thus in particular can control the coolant pump and/or control valve or determine an actuating value for controlling the coolant pump or control valve.

BRIEF DESCRIPTION OF THE DRAWINGS

The present disclosure will hereinafter be described in conjunction with the following drawing figures, wherein like numerals denote like elements.

DETAILED DESCRIPTION

Figure 1:
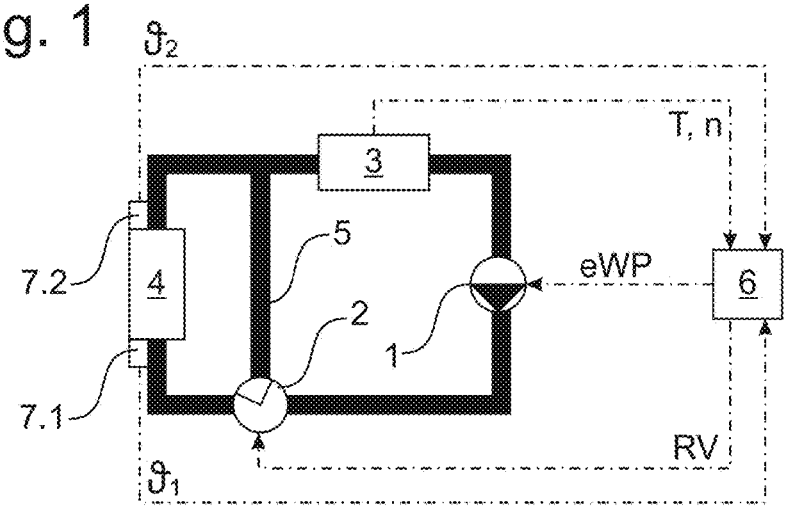
FIG. 1 schematically represents an internal combustion engine of a motor vehicle having a cooling system and a controller.

The following detailed description is merely exemplary in nature and is not intended to limit the invention or the application and uses of the invention. Furthermore, there is no intention to be bound by any theory presented in the preceding background of the invention or the following detailed description.

The motor vehicle includes an internal combustion engine 3 and a cooling system for cooling the internal combustion engine 3 with a coolant circuit, which includes a heat exchanger 4 and a bypass 5 that fluidically bridges the heat exchanger 4. The cooling system includes an electrically activatable coolant pump 1 for variably conveying a coolant into the coolant circuit based on a pump actuating value (eWP) and an electrically activatable control valve 2 for variably dividing a coolant flow between the heat exchanger 4 and the bypass 5 based on a valve actuating value (RV).

Temperature sensors 7.1, 7.2 acquire a coolant temperature $\vartheta_1$, $\vartheta_2$ at the inlet and outlet of the heat exchanger 4 (respectively), and transmits a signal representing the coolant temperatures ($\vartheta_1$, $\vartheta_2$) to the controller 6, which determines a temperature difference ($\Delta\vartheta$) of the heat exchanger 4 from the latter. In addition, the controller 6 acquires a signal representing a torque variable (T) and a speed variable (n) of the internal combustion engine 3.

Figure 2:
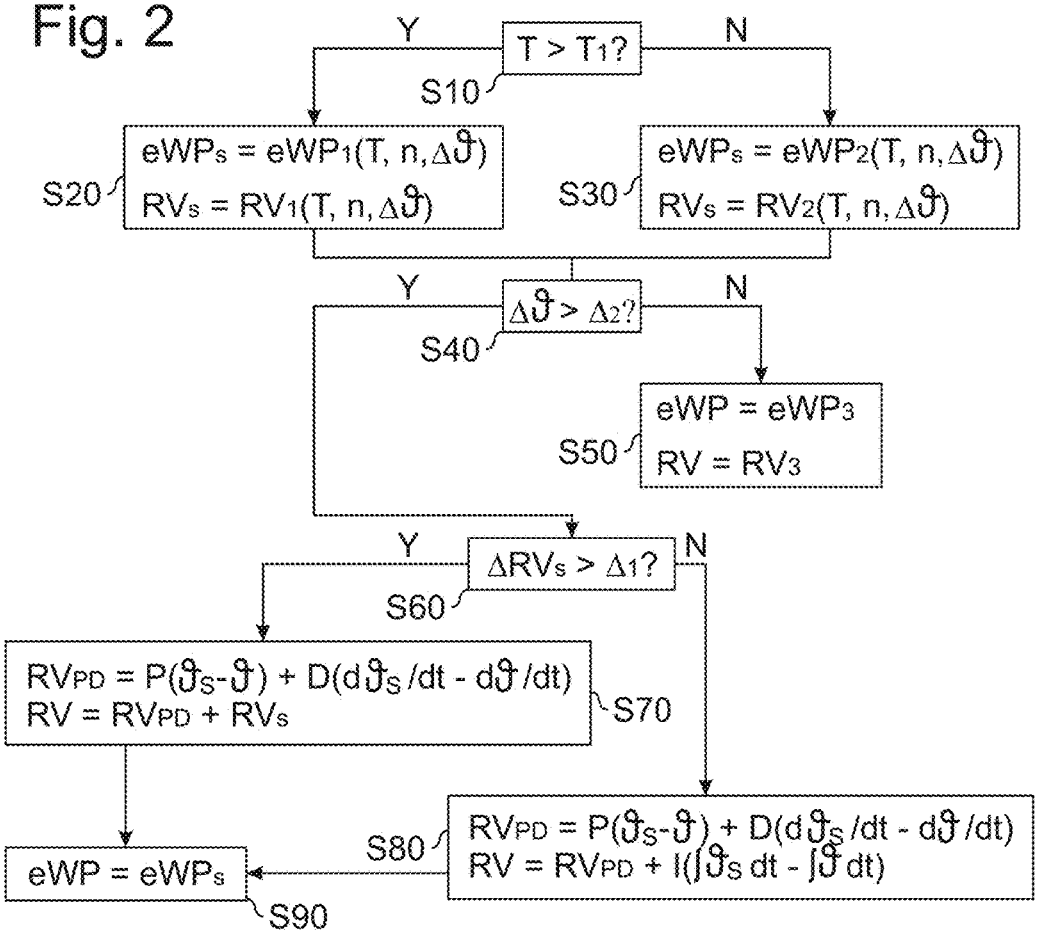
FIG. 2 is a flow chart illustrating the sequence of a method for controlling a coolant pump and/or control valve of a cooling system.

With respect to FIG. 2, the sequence of a method according to an embodiment of the present disclosure will be explained below, which is implemented by the controller 6, which is set up correspondingly for this purpose, in particular from a programming standpoint. As a consequence, the controller 6 or elements thereof in particular include a device or means according to an aspect of the present disclosure that is provided or set up to implement the method described herein.

A first step S10 involves checking whether a load variable in the form of a torque (T) of the internal combustion engine satisfies a prescribed condition, in the exemplary embodiment whether it exceeds a prescribed limit ($T_1$) or not.

If the load variable (T) of the internal combustion engine 3 satisfies the prescribed condition $T>T_1$ (S10: "Y"), step S20 is performed in a first determination mode to determine a pre-control value ($eWP_S$) for ascertaining the pump actuating value (eWP) based on a prescribed first allocation ($eWP_1$) as a function of the output variable (T, n) of the internal combustion engine 3 and the temperature difference ($\Delta\vartheta$) of the heat exchanger 4. In addition, step S20 is performed in this first determination mode to determine a pre-control value ($RV_S$) for ascertaining the valve actuating value (RV) based on a prescribed first allocation $RV_1$ as a function of the output variable (T, n) of the internal combustion engine 3 and the temperature difference ($\Delta\vartheta$) of the heat exchanger 4.

If the load variable (T) of the internal combustion engine 3 does not satisfy the prescribed condition $T>T_1$ (S10: "N"), step S30 is performed in a second determination mode to determine a pre-control value ($eWP_S$) for ascertaining the pump actuating value (eWP) based on a prescribed second allocation $eWP_2 \neq eWP_1$ as a function of the output variable (T, n) of the internal combustion engine 3 and the temperature difference ($\Delta\vartheta$) of the heat exchanger 4. In addition, step S30 is performed in this second determination mode to determine a pre-control value ($RV_S$) for ascertaining the valve actuating value (RV) based on a prescribed second allocation $RV_2 \neq RV_1$ as a function of the output variable (T, n) of the internal combustion engine 3 and the temperature difference ($\Delta\vartheta$) of the heat exchanger 4. In particular, the allocations $eWP_1$ (T, n, $\Delta\vartheta$), $eWP_2$ (T, n, $\Delta\vartheta$), $RV_1$ (T, n, $\Delta\vartheta$) and $RV_2$ (T, n, $\Delta\vartheta$) can be determined in the form of characteristic diagrams or lines, in particular be stored in the controller 6.

After step S20 or S30, step S40 is performed to check whether a state variable of the cooling system in the form of the temperature difference ($\Delta\vartheta$) of the heat exchanger 4 satisfies a prescribed condition, in the exemplary embodiment whether it exceeds a prescribed limit ($\Delta_2$) or not.

If the state variable ($\Delta\vartheta$) of the heat exchanger 4 satisfies the prescribed condition $\Delta\vartheta > \Delta_2$ (S40: "Y"), the pre-control values ($eWP_S$, $RV_S$) determined in steps S20 or S30 in the first determination mode are retained, and a jump is made directly to step S60.

If the state variable ($\Delta\vartheta$) of the heat exchanger 4 does not satisfy the prescribed condition $\Delta\vartheta > \Delta_2$ (S40: "YN"), a step S50 is performed in a second determination mode to set a pump actuating value (eWP) and valve actuating value (RV) to values $eWP_3$ and $RV_3$, which are pre-determined in the exemplary embodiment.

The state variable checked in step S40 can additionally or alternatively include other variables. For example, a predetermined pump actuating value (eWP) and valve actuating value (RV) can be computed in step S50 even if the control valve 2 was in a prescribed position for a prescribed time or the like.

After a positive step S40, step S60 is performed to check whether a prescribed criterion has been satisfied or not. In the exemplary embodiment, the criterion encompasses a change rate ($\Delta RV_S$) of the pre-control value ($RV_S$) determined in step S20, S30 for ascertaining the valve actuating value (RV). If this change ($\Delta RV_S$) rate exceeds a prescribed limit $\Delta_1$ (S60: "Y"), step S70 is performed in a first control mode to determine the valve actuating value (RV) based on a sum of the pre-control value ($RV_S$) and a control value ($RV_{PD}$), which is determined in a known manner based on a control deviation between a desired temperature variable ($\vartheta_S$) and an actual temperature variable ($\vartheta$) of the coolant or motor and a differential variable ($d\vartheta_S/dt$ or $d\vartheta/dt$) thereof. This is denoted on FIG. 2 with the PD regulator structure as follows:

$$RV_{PD} = P \cdot (\vartheta_S - \vartheta) + D \cdot (d\vartheta_S/dt - d\vartheta/dt)$$

wherein:

P represents the proportional gain; and

D represents the differential gain.

If the change rate ($\Delta RV_S$) does not exceed the prescribed limit $\Delta_1$ (S60: "N"), step S80 is performed in a second control mode to determine the valve actuating value (RV) based on a sum of the control value ($RV_{PD}$) and an integral variable of the control deviation ($\int\vartheta_s dt$ or $\int\vartheta dt$). In other words, the integral portion is replaced by the pre-control value ($RV_S$) in a PID regulator as long as the criterion $\Delta RV_S > \Delta_1$ is satisfied.

In a step S90, the pre-control value ($eWP_S$) for determining the pump actuating value (eWP) is determined as the pump actuating value (eWP), and the coolant pump 1 is correspondingly actuated by the controller 6. As a consequence, the coolant pump 1 is feed forward-controlled independently of a control deviation between a desired and actual temperature variable ($\vartheta_S$, $\vartheta$) based on the pre-control value ($eWP_S$).

By contrast, the valve actuating value (RV), as explained above with reference to steps S70, S80, is determined based on a control deviation between a desired and actual temperature variable ($\vartheta_S$, $\vartheta$), and the control valve 2 is correspondingly actuated by the controller 6. As a consequence, the control valve 2 is feedback-controlled based on a control deviation between a desired and actual temperature variable ($\vartheta_S$, $\vartheta$), in particular PID controlled, wherein the integral portion is replaced by the pre-control value ($RV_S$), if necessary.

If the state variable ($\Delta\vartheta$) of the heat exchanger 4 does not satisfy the prescribed condition $\Delta\vartheta > \Delta_2$ (S40: "N"), the coolant pump 1 and control valve 2 are instead actuated according to the pump actuating value ($eWP = eWP_S$) and valve actuating value ($RV = RV_3$) determined in step S50.

Accordingly, FIG. 1 denotes the actuation of the coolant pump 1 according to or with the pump actuating value (eWP), and denotes the actuation of the control valve 2 according to or with the valve actuating value by way of the controller 6.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment, it being understood that various changes may be made in the function and arrangement of elements described in an exemplary embodiment without departing from the scope of the invention as set forth in the appended claims and their legal equivalents.

What is claimed is:

1. A method for adjusting a cooling system having a coolant pump and a control valve for an internal combustion engine based on an actuating value thereof comprising:

acquiring a first temperature signal representing an inlet temperature of a heat exchanger in the cooling system;

acquiring a second temperature signal representing an outlet temperature of the heat exchanger;

determining a state variable based on a difference of the first and second temperature signals;

acquiring an output variable including at least one of a load variable and a speed variable of the internal combustion engine;

determining a pre-control value for ascertaining the actuating value in a first determination mode based on a prescribed first allocation as a function of the state variable and the output variable and then determining the actuating value using the pre-control value;

adjusting at least one of the coolant pump and the control valve based on the actuating value; and determining a control value based on a control deviation between at least one of a proportional variable and a differential variable between a desired temperature and an actual temperature, wherein the actuating value is in a first control mode determined based on the control value and the pre-control value when a prescribed control criterion has been satisfied, and the actuating value is in a second control mode differing from the first control mode determined based on the control value and an integral variable of the control deviation when the criterion has not been satisfied.

2. The method according to claim 1, further comprising:
adjusting the control valve based on a control deviation between a desired temperature variable and an actual temperature variable; and
adjusting the coolant pump based on the pre-control value and independently of the control deviation between the desired temperature variable and the actual temperature variable.

3. The method according to claim 1, wherein the output variable comprises the load variable and the speed variable.

4. The method according to claim 1, wherein the first temperature signal represents a temperature of coolant entering the heat exchanger and the second temperature signal represents a temperature coolant exiting the heat exchanger, and the state variable is a temperature difference between the inlet coolant temperature and an outlet coolant temperature.

5. The method according to claim 1, wherein the actuating value is determined in the second determination mode is a pre-determined value.

6. The method according to claim 1, wherein the actuating value is determined in the second determination mode based on a prescribed second allocation differing from the first allocation as a function of the output variable and the state variable.

7. The method according to claim 1, wherein the pre-control value is determined in the first determination mode based on the prescribed first allocation as a function of the output variable and the state variable when the load variable satisfies a prescribed load condition, and in a second determination mode differing from the first determination mode based on a prescribed second allocation differing from the first prescribed allocation as a function of the output variable and the state variable when the load variable does not satisfy the prescribed load condition.

8. The method according to claim 1, wherein the load variable comprises a torque variable of the internal combustion engine.

9. A motor vehicle comprising an internal combustion engine and a cooling system for cooling the internal combustion engine with a coolant circuit, a coolant pump for variably conveying a coolant in the coolant circuit based on a pump actuating value, a heat exchanger, a bypass that fluidically bridges the heat exchanger, a control valve for variably dividing a coolant flow between the heat exchanger and the bypass based on a valve actuating value, and a controller configured to perform the method according to claim 1.

10. A computer program product with a program code stored on a non-transitory computer-readable medium which when executed on a controller implements the method according to claim 1.

11. A method for adjusting a cooling system having a coolant pump and a control valve for an internal combustion engine based on an actuating value thereof comprising:
acquiring a first temperature signal representing an inlet temperature of a heat exchanger in the cooling system;
acquiring a second temperature signal representing an outlet temperature of the heat exchanger;
determining a state variable based on a difference of the first and second temperature signals;
comparing the state variable to a prescribed condition;
acquiring an output variable including at least one of a load variable and a speed variable of the internal combustion engine;
determining a pre-control value for ascertaining the actuating value in a first determination mode when the state variable satisfies the prescribed condition based on a prescribed first allocation as a function of the state variable and the output variable and then determining the actuating value based on the pre-control value;
determining the actuating value in a second determination mode differing from the first determination mode when the state variable does not satisfy the prescribed condition;
adjusting at least one of the coolant pump and the control valve based on the actuating value; and
determining a control value based on a control deviation between at least one of a proportional variable and a differential variable of a desired temperature and an actual temperature, wherein the actuating value is in a first control mode determined based on the control value and the pre-control value when a prescribed control criterion has been satisfied, and the actuating value is in a second control mode differing from the first control mode determined based on the control value and an integral variable of the control deviation when the criterion has not been satisfied.

12. The method according to claim 11, further comprising:
adjusting the control valve based on a control deviation between a desired temperature variable and an actual temperature variable; and
adjusting the coolant pump based on the pre-control value and independently of the control deviation between the desired temperature variable and the actual temperature variable.

* * * * *